US008186227B2

(12) United States Patent
Ashrafzadeh

(10) Patent No.: US 8,186,227 B2
(45) Date of Patent: May 29, 2012

(54) METHOD AND APPARATUS FOR DETERMINING LOAD AMOUNT IN A LAUNDRY TREATING APPLIANCE

(75) Inventor: Farhad Ashrafzadeh, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 368 days.

(21) Appl. No.: 12/538,528

(22) Filed: Aug. 10, 2009

(65) Prior Publication Data

US 2011/0030460 A1 Feb. 10, 2011

(51) Int. Cl.
*G01B 5/30* (2006.01)

(52) U.S. Cl. ..... 73/760; 68/12.04

(58) Field of Classification Search ..... 73/760, 73/774, 781, 855; 8/400; 68/12.04
See application file for complete search history.

(56) References Cited

U.S. PATENT DOCUMENTS

| | | | | |
|---|---|---|---|---|
| 4,741,182 | A | 5/1988 | Didier et al. | |
| 5,335,524 | A | 8/1994 | Sakane | |
| 5,507,055 | A * | 4/1996 | Blauert et al. | 8/159 |
| 6,023,854 | A * | 2/2000 | Tsunomoto et al. | 34/531 |
| 6,374,444 | B2 | 4/2002 | Skrippek et al. | |
| 6,460,381 | B1 * | 10/2002 | Yoshida et al. | 68/12.04 |
| 7,325,422 | B2 | 2/2008 | Seo et al. | |
| 7,331,075 | B2 | 2/2008 | Lee et al. | |
| 7,401,480 | B2 | 7/2008 | Poehler | |
| 7,412,740 | B2 | 8/2008 | Park et al. | |
| 2005/0016227 | A1 | 1/2005 | Lee | |
| 2005/0066999 | A1 * | 3/2005 | Dietz et al. | 134/18 |
| 2005/0160536 | A1 | 7/2005 | McAllister et al. | |
| 2006/0242768 | A1 | 11/2006 | Zhang et al. | |
| 2007/0050916 | A1 | 3/2007 | Lee et al. | |
| 2010/0205826 | A1 * | 8/2010 | Ashrafzadeh et al. | 34/499 |
| 2011/0030150 | A1 * | 2/2011 | Ashrafzadeh et al. | 8/159 |

FOREIGN PATENT DOCUMENTS

| | | | |
|---|---|---|---|
| EP | 0410827 | A1 | 1/1991 |
| EP | 0600188 | A1 | 6/1994 |
| EP | 1113102 | A1 | 7/2001 |
| WO | 00/04220 | A1 | 1/2000 |
| WO | 03/046271 | A1 | 6/2003 |

* cited by examiner

*Primary Examiner* — Max Noori
(74) *Attorney, Agent, or Firm* — Clifton G. Green; McGarry Bair PC

(57) ABSTRACT

A method for determining the amount of laundry in a laundry treating appliance comprises determining a first load amount based on a characteristic of the oscillating of a drum and determining if the first load amount satisfies a load amount threshold. When the first load amount satisfies the load threshold, the drum may be rotated in accordance with a laundry inertia algorithm to determine inertia of the load. The second load amount may then be determined based on the inertia of the laundry.

24 Claims, 10 Drawing Sheets

METHOD AND APPARATUS FOR DETERMINING LOAD AMOUNT IN A LAUNDRY TREATING APPLIANCE

BACKGROUND OF THE INVENTION

Laundry treating appliances, such as clothes washers, refreshers, and non-aqueous systems, may have a configuration based on a rotating drum that defines a treating chamber in which laundry items are placed for treating. The laundry treating appliance may have a controller that implements a number of pre-programmed cycles of operation having one or more operating parameters. The controller may automatically determine the load amount in the treating chamber and use the determined load amount to set one or more operating parameters.

An inertia method is most commonly used to determine the load amount. This method requires high drum rotation speeds to generate greater than a 1 g centrifugal force to plaster the laundry to drum. For certain laundry types, such as delicates, or conductions, such as dry, the inertia method may be detrimental to the long-term wear of the laundry. While the determination of the load amount is important in setting operating parameters during a cycle of operation, it may be necessary to forego the determination when the situation is such that the laundry may be damaged.

BRIEF DESCRIPTION OF THE INVENTION

A method for determining the amount of laundry in a laundry treating appliance comprising oscillating a drum about a predetermined position, determining a first load amount based on a characteristic of the oscillating of the drum, and determining if the first load amount satisfies a load amount threshold. When the first load amount satisfies the load threshold, the drum may be rotated in accordance with a laundry inertia algorithm to determine inertia of the load. The second load amount may then be determined based on the inertia of the laundry.

DESCRIPTION OF AN EMBODIMENT OF THE INVENTION

Figure 1:
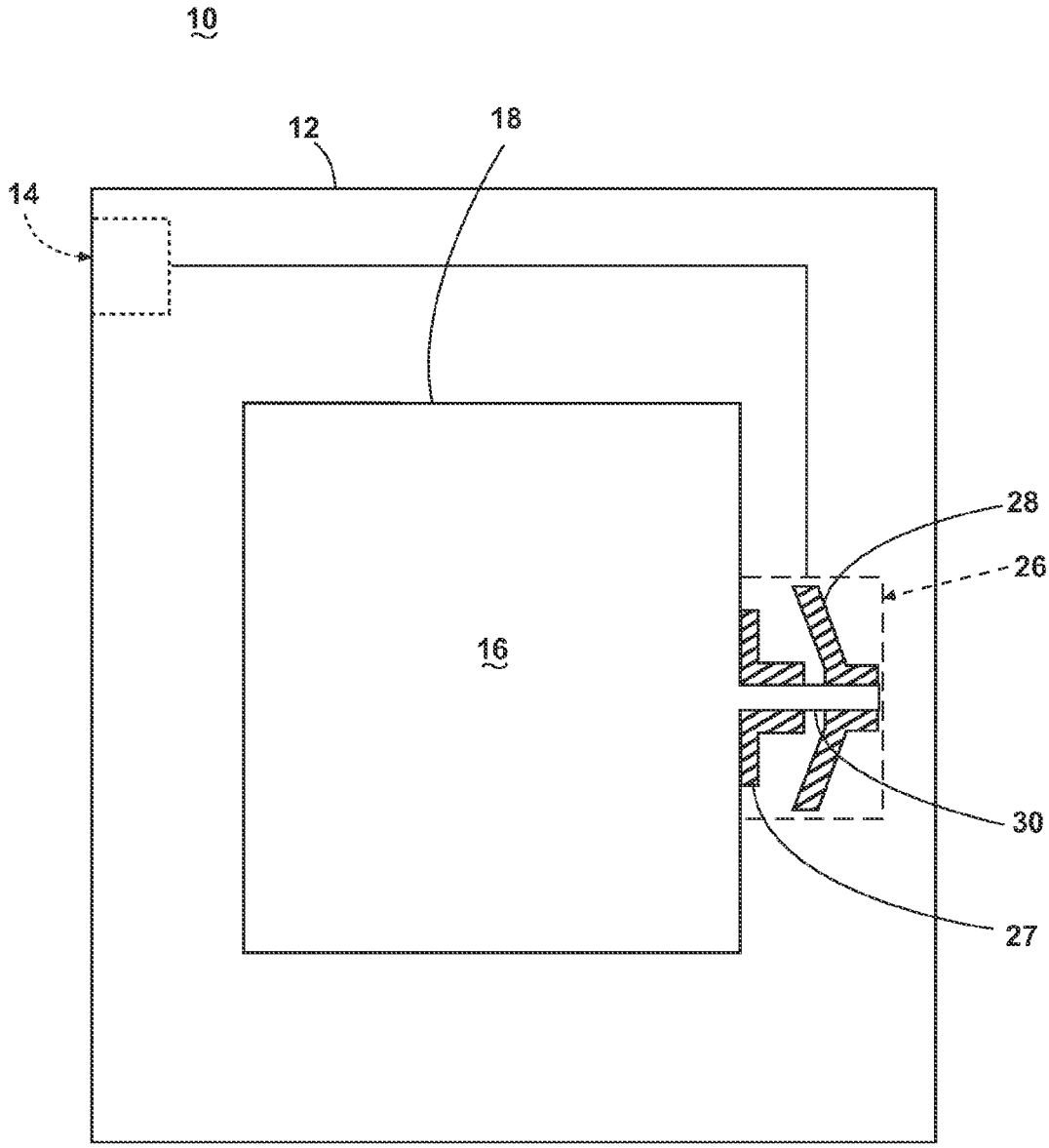
FIG. 1 is a schematic view of a laundry treating appliance according to a first embodiment of the invention.

FIG. 1 illustrates one embodiment of a laundry treating appliance according to the invention. The laundry treating appliance 10, according to the invention, may be any appliance that performs a cycle of operation on laundry, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine.

The laundry treating appliance 10 may include a cabinet 12 having a controller 14 for controlling the operation of the laundry treating appliance 10 to complete a cycle of operation. A treating chamber 16 may be defined by a rotatable drum 18 located within the cabinet 12 for receiving laundry to be treated during a cycle of operation. The drum 18 may be coupled with a motor 26 having a stator 27 and a rotor 28 through a drive shaft 30 for selective rotation of the drum 18 during a cycle of operation.

The controller 14 may be operably coupled with the motor 26 to control the motor 26 to oscillate or rotate the drum 118 about a predetermined position according to one or more motor control algorithms stored in a memory of the controller 14. The controller 14 may also be coupled with the motor 26 to receive information from the motor 26 that may be used to determine the angular position of the drum 18 as it is oscillated or rotated about the predetermined position. The controller 14 may store the angular position information in its memory for analysis using software that can also be stored in its memory to determine the amount of a load present within the drum 18.

Figure 2:
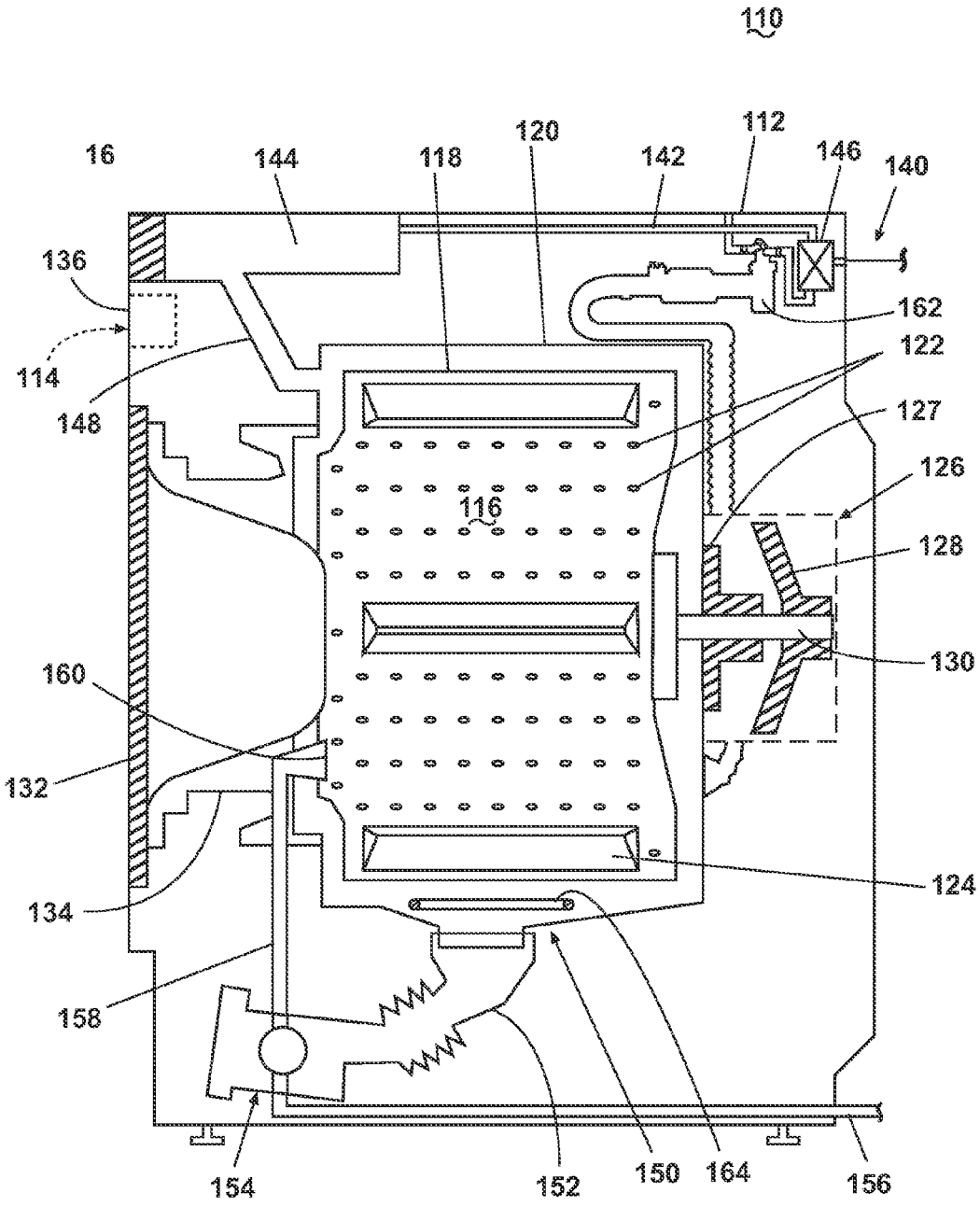
FIG. 2 is a schematic view of a laundry treating appliance according to a second embodiment of the invention.

FIG. 2 illustrates a second embodiment of the invention in the form of a washing machine 110, which is similar in structure to the laundry treating appliance 10. Therefore, elements in the washing machine 110 similar to the laundry treating appliance 10 will be numbered with the prefix 100. The washing machine 110 described herein shares many features of a traditional automatic washing machine, which will not be described in detail except as necessary for a complete understanding of the invention.

FIG. 2 provides a schematic view of the washing machine 110 that may include a cabinet 112 having a controller 114 for controlling the operation of the washing machine 110 to complete a cycle of operation. A treating chamber 116 may be defined by a rotatable drum 118 located within the cabinet 112 for receiving laundry, such as fabric items, to be treated during a cycle of operation. The rotatable drum 118 may be mounted within a tub 120 and may include a plurality of perforations 122, such that liquid may flow between the tub 120 and the drum 118 through the perforations 122.

The drum 118 may further include a plurality of baffles 124 disposed on an inner surface of the drum 118 to lift the laundry load contained in the laundry treating chamber 116 while the drum 118 rotates. A motor 126 may be directly coupled with a drive shaft 130 to rotate the drum 118. The motor 126 may be a brushless permanent magnet (BPM) motor having a stator 127 and a rotor 128. Alternately, the motor 126 may be coupled to the drum 118 through a belt and a drive shaft to rotate the drum 118, as is known in the art. Other motors, such as an induction motor or a permanent split capacitor (PSC) motor, may also be used. The motor 126 may rotate the drum 118 at various speeds in either rotational direction.

Both the tub 120 and the drum 118 may be selectively closed by a door 132. A bellows 134 may couple an open face of the tub 120 with the cabinet 112, and the door 132 may seal against the bellows 134 when the door 132 closes the tub 120. The cabinet 112 may also include a user interface 136 that may include one or more knobs, switches, displays, and the like for communicating with the user, such as to receive input and provide output.

While the illustrated washing machine 110 includes both the tub 120 and the drum 118, with the drum 118 defining the laundry treating chamber 116, it is within the scope of the invention for the washing machine 110 to include only one receptacle, with the receptacle defining the laundry treating chamber for receiving the laundry load to be treated.

The washing machine 110 of FIG. 2 may further include a liquid supply and recirculation system. Liquid, such as water, may be supplied to the washing machine 110 from a water supply 140, such as a household water supply. A supply conduit 142 may fluidly couple the water supply 140 to the tub 120 and a treatment dispenser 144. The supply conduit 142 may be provided with an inlet valve 146 for controlling the flow of liquid from the water supply 140 through the supply conduit 142 to either the tub 120 or the treatment dispenser 144.

A liquid conduit 148 may fluidly couple the treatment dispenser 144 with the tub 120. The liquid conduit 148 may couple with the tub 120 at any suitable location on the tub 120 and is shown as being coupled to a front wall of the tub 120 in FIG. 2 for exemplary purposes. The liquid that flows from the treatment dispenser 144 through the liquid conduit 148 to the tub 120 typically enters a space between the tub 120 and the drum 118 and may flow by gravity to a sump 150 formed in part by a lower portion of the tub 120. The sump 150 may also be formed by a sump conduit 152 that may fluidly couple the lower portion of the tub 120 to a pump 154. The pump 154 may direct fluid to a drain conduit 156, which may drain the liquid from the washing machine 110, or to a recirculation conduit 158, which may terminate at a recirculation inlet 160. The recirculation inlet 160 may direct the liquid from the recirculation conduit 158 into the drum 118. The recirculation inlet 160 may introduce the liquid into the drum 118 in any suitable manner, such as by spraying, dripping, or providing a steady flow of the liquid.

The liquid supply and recirculation system may further include one or more devices for heating the liquid such as a steam generator 162 and/or a sump heater 164.

The steam generator 162 may be provided to supply steam to the treating chamber 116, either directly into the drum 118 or indirectly through the tub 120 as illustrated. The valve 146 may also be used to control the supply of water to the steam generator 162. The steam generator 162 is illustrated as a flow through steam generator, but may be other types, including a tank type steam generator. Alternatively, the heating element 164 may be used to generate steam in place of or in addition to the steam generator 162. The steam generator 162 may be controlled by the controller 114 and may be used to heat to the laundry as part of a cycle of operation, much in the same manner as heating element 164. The steam generator 162 may also be used to introduce steam to treat the laundry as compared to merely heating the laundry.

Additionally, the liquid supply and recirculation system may differ from the configuration shown in FIG. 2, such as by inclusion of other valves, conduits, wash aid dispensers, sensors, such as water level sensors and temperature sensors, and the like, to control the flow of liquid through the washing machine 110 and for the introduction of more than one type of detergent/wash aid. Further, the liquid supply and recirculation system need not include the recirculation portion of the system or may include other types of recirculation systems.

Figure 3:
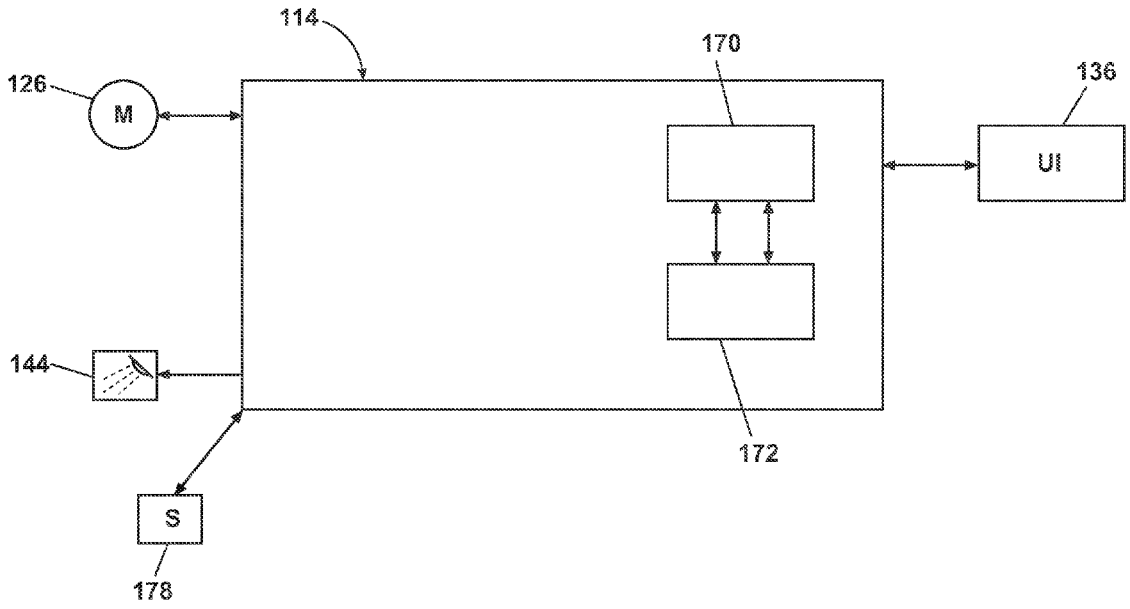
FIG. 3 is a schematic view of a control system of the laundry treating appliance of FIG. 2 for use with any embodiment.

As illustrated in FIG. 3, the controller 114 may be provided with a memory 170 and a central processing unit (CPU) 172. The memory 170 may be used for storing the control software that is executed by the CPU 172 in completing a cycle of operation using the washing machine 110 and any additional software. The memory 170 may also be used to store information, such as a database or table, and to store data received from one or more components of the washing machine 110 that may be communicably coupled with the controller 114.

The controller 114 may be operably coupled with one or more components of the washing machine 110 for communicating with and controlling the operation of the component to complete a cycle of operation. For example, the controller 114 may be coupled with the motor 126 for controlling the direction and speed of rotation of the drum 118 and the treatment dispenser 144 for dispensing a treatment during a cycle of operation. The controller 114 may also be coupled with the user interface 136 for receiving user selected inputs and communicating information to the user.

The controller 114 may also receive input from one or more sensors 178, which are known in the art and not shown for simplicity. Non-limiting examples of sensors 178 that may by communicably coupled with the controller 114 include: a treating chamber temperature sensor, a moisture sensor, a weight sensor, a position sensor and a motor torque sensor.

The controller 114 may be operably coupled with the motor 126 to control the motor 126 to oscillate or rotate the drum 118 about a predetermined position according to one or more motor control algorithms stored in the memory 170 of the controller 114. The controller 114 may also be coupled with the motor 126 to receive information from the motor 126 that may be used to determine the angular position of the drum 118 as it is oscillated or rotated about the predetermined position. The controller 114 may store the angular position information in its memory 170 for analysis using software that can also be stored in the memory 170 to determine the amount of a load present within the drum 118.

The motor 126 may be provided with a sensorless drive for determining the position of the rotor 128, which may also be used by the controller 114 to determine the angular position of the drum 118. Alternatively, the motor 126 may be provided with a position sensor such as a Hall sensor, for example, for determining the angular position of the drum 118.

The previously described laundry treating appliances 10 and 110 may be used to implement one or more embodiments of a method of the invention. Several embodiments of the method will now be described in terms of the operation of the washing machine 110. While the methods are described with respect to the washing machine 110, the methods may also be used with the laundry treating appliance 10 of the first embodiment of the invention. The embodiments of the method function to automatically determine the amount of a laundry load comprising one or more fabric items in the treating chamber 116. The method may be used to determine the amount of dry laundry prior to the addition of liquid to the treating chamber 116. It is also within the scope of the invention for the method to be used to determine the amount of laundry after the addition of liquid to the laundry. As used herein, the amount of laundry may include one or more characteristics of the laundry including the weight, mass, inertia, volume, diameter, circumference and any other physical dimension.

Figure 4:
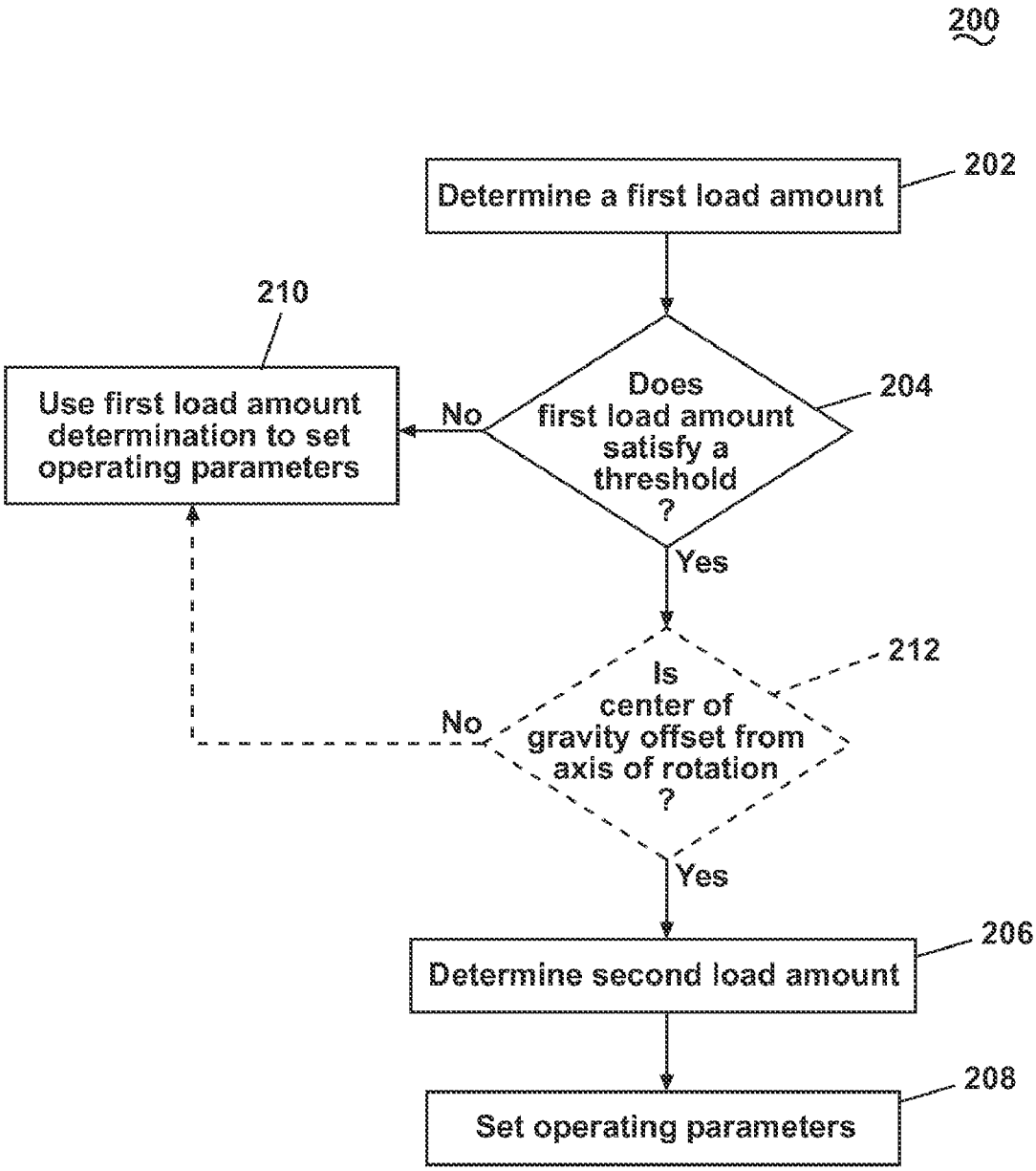
FIG. 4 is a flow chart illustrating a method for determining the load amount within a laundry treating appliance according to a third embodiment of the invention.

Referring now to FIG. 4, a flow chart of one embodiment of a method 200 for determining the amount of laundry is illustrated. The sequence of steps depicted is for illustrative purposes only, and is not meant to limit the method 200 in any way as it is understood that the steps may proceed in a different logical order or additional or intervening steps may be included without detracting from the invention.

The method 200 starts with assuming that the user has already placed one or more load items for treatment within the treating chamber 116 and selected a cycle of operation through the user interface 136. The method 200 may be initiated at the beginning of a cycle of operation or prior to the start of a cycle of operation. At 202 the controller 114 may determine a first load amount according to a first load amount method. At 204 the controller 114 may determine whether or not the first load amount determined at 202 satisfies a predetermined threshold value. If the first load amount determined at 202 satisfies the threshold value, the controller 114 may determine a second load amount according to a second load amount method at 206. The second load amount may then be used to set one or more operating parameters for completing a cycle of operation at 208. If the first load amount determined at 202 does not satisfy the threshold value, the controller 114 may use the first load amount to set one or more operating parameters at 210.

Non-limiting examples of operating parameters that may be set by the controller includes speed and time of rotation during a wetting, wash, rinse and extraction process, an amount of liquid to add to the load and an amount of a treatment to dispense. Setting operating parameters according to the method 200 may improve the consistency of the outcome of the operating cycles.

The method 200 may also include an optional process 212 for determining if the center of gravity of the load is offset from the axis of rotation. If the first load amount determined at 202 satisfies the threshold value at 204, the controller 114 may then determine if the center of gravity is offset from an axis of rotation of the drum 118 at 212. If the center of gravity is offset from the axis of rotation of the drum 118, the controller 114 may then determine the second load amount at 206. If the center of gravity is not offset from the axis of rotation, the controller 114 may then decide to not determine the second load amount and use the first load amount determined at 202 to set one or more operating parameters at 210.

The method 200 provides a method for determining the amount of the load according to a first load amount method that may be less likely to accelerate the natural wearing process of the fabric load than the second load amount. The first load amount method may have one or more characteristics that may make it less likely to accelerate the natural wearing process of the fabric load depending on the type of fabric and the amount of the load. For example, the first load amount method may require lower rotational speeds and/or less time than the second load amount method. Additionally, the first load amount method may be used to determine the amount of the dry load prior to the addition of water. Alternatively, certain laundry or fabric types may be more suited to one method because of the different methodology used. For example, delicate laundry may be more suitable for lower rotational speed methods as compared to a high rotational speed method, and heavy duty laundry types, such as denim, may be amenable to all types of testing.

The second load amount method may be any type of inertia-based algorithm known in the art for estimating the amount of the load. Examples of suitable inertia-based methods include determining the time it takes to accelerate between two pre-determined speeds under a constant applied torque, determining the time to decelerate from a first speed to a second speed and measuring the torque required to rotate a load at a predetermined constant speed. These types of inertia-based methods may require high speeds and high acceleration/deceleration rates that may lead to longer operating time and are not always suitable for use to determine the amount of the load when it is dry, as they may accelerate the natural wearing process of the fabric load. In addition, an inertial-based algorithm may not always be the most suitable method if one or more items of the load is a large or bulky item that occupies a large fraction of the treating chamber 116.

One example of an inertia-based method for determining the amount of the load is disclosed in U.S. Patent Application No. 2006242768 to Zhang et al. assigned to the same assignee as the present invention, which is incorporated in full by reference. The method includes determining the average power consumed as the drum is accelerated and decelerated during a ramp-up and a ramp-down phase in which the drum is accelerated from a first speed below the satelliting speed to the satelliting speed and then decelerated from the satelliting speed to the first speed. The average power consumed during the ramp-up and ramp-down phase is used to calculate the inertia of the load which may then be used to determine the amount of the load using known methods.

Another example of an inertia-based method for determining the amount of the load is disclosed in U.S. Pat. No. 6,505,369 to Weinmann, which is incorporated in full by reference. The method includes accelerating the drum to a speed above the satelliting speed and then a constant, high braking torque is applied to overwhelm the affects of friction. The inertia may be determined from the deceleration rate and the required braking torque. The inertia may then be used to estimate the amount of the load using known methods.

Another example of an inertia-based method for determining the amount of the load is disclosed in U.S. Pat. No. 7,162,759 to Weinmann, which is incorporated in full by reference. This method includes accelerating and decelerating the drum to two constant speed steps, which are used to determine the motor power to overcome friction. The power consumed by the motor during an acceleration ramp is then determined. The difference between the energy consumed during the acceleration ramp and the two constant speed phases is used to determine the load inertia, which may then be used to estimate the amount of the load. This method also involves accelerating the drum to speeds above the satelliting speed.

The method 200 provides a way to evaluate whether the load is amenable to the second load amount method or that the second load amount method may contribute to the natural wearing process of the fabric load more than is desired. The evaluation may be based on the amount of the load as it is determined using the first load amount method, and optionally based on the center of gravity of the load.

The determination of the center of gravity at 212 may also be used in combination with the first load amount determined at 202 to if it is suitable to use the second load amount determining method at 206. For example, if the center of gravity of the load is determined to be close to the axis of rotation of the drum 118, this may indicate that the volume of the load substantially fills the volume of the treating chamber 116. This may occur if too many items are loaded into the drum 118 or if one or more of the items is a bulky item, such as a jacket, comforter or pillow, for example. If the volume of the load substantially fills the volume of the treating chamber 116, even if the weight of the load determined at 202 is less than a threshold value, it may be determined that the second load amount method may contribute to the natural wearing process of the fabric load and is not suitable for determining the load amount and the first load amount may be used to set one or more operating parameters at 208.

The threshold value used for determining which of the first and second load amount methods is more suitable at 204 may be determined experimentally and stored in the memory 170 of the controller 114. The parameters for determining whether the center of gravity is offset from the axis of rotation at 212 may also be determined experimentally for a plurality of load amounts and stored in the memory 170 of the controller 114.

Figure 5:
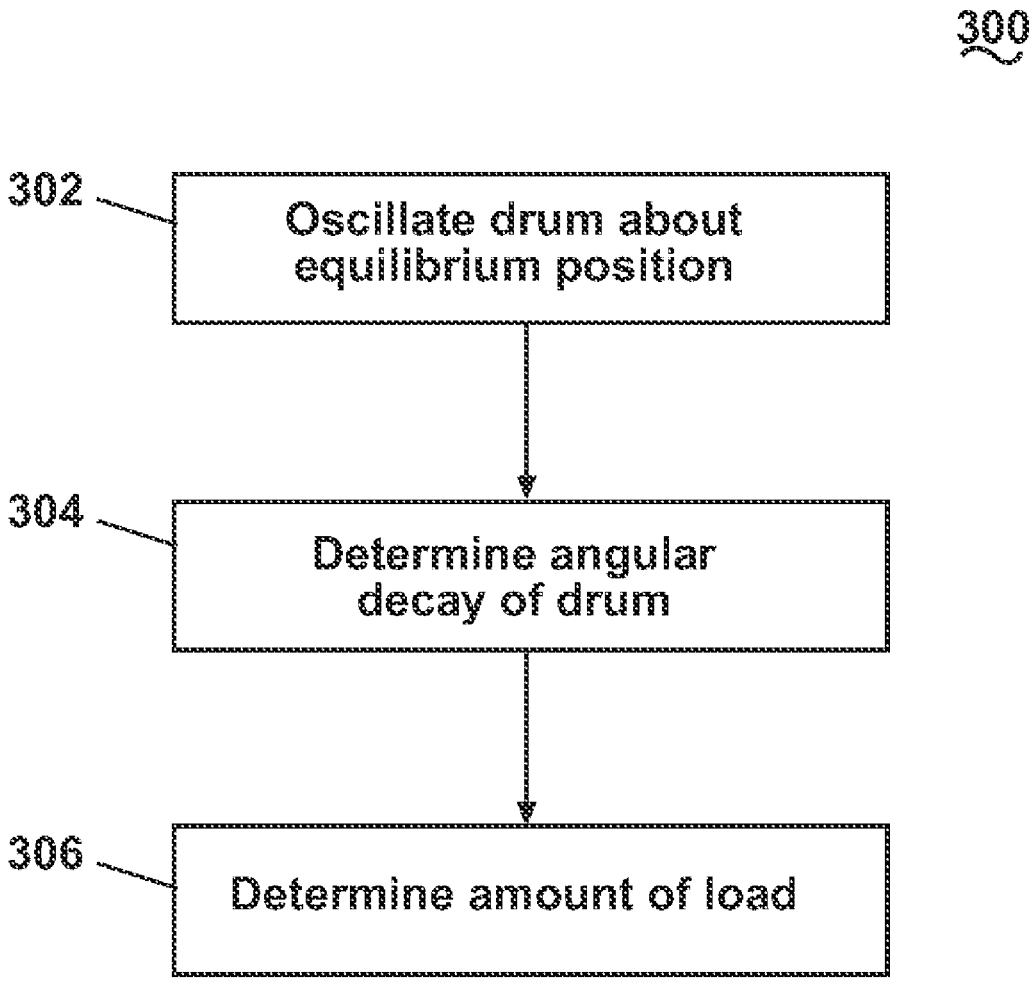
FIG. 5 is a flow chart illustrating a method for determining a first load amount of a load within a laundry treating appliance according to a fourth embodiment of the invention.

FIG. 5 illustrates an example of a suitable first load amount method 300 that may be used at 202 in the method 200 of FIG. 4. The method 300 includes a motor control algorithm that may control the motor 126 to oscillate the drum 118 about a predetermined position by simulating a torsional spring. The predetermined position may be an equilibrium position defined by the bottom of the drum 118 in its resting position. Alternatively, the predetermined position may be some position offset from the equilibrium position. This method is disclosed in greater detail in Applicant's co-pending application bearing Applicant's reference number US20080586, entitled "Method and Apparatus for Determining Load Amount in a Laundry Treating Appliance," which is herein incorporated by reference in full.

At 302 the controller 114 may drive the motor 126 to oscillate the drum 118 about a predetermined position according to a motor control algorithm stored within the memory 170 of the controller 114. While greater angular displacements are possible, to achieve the goals of the invention, the drum need only be oscillated through relatively small angular displacements, which may by less than plus/minus 180 degrees. At 304 the controller 114 may determine the angular decay of the drum 118 relative to the predetermined position. At 306 the controller 114 may determine the amount of the load from the angular decay of the drum 118 determined at 304.

The method 300 may be completed one or more times. If the method 300 is repeated multiple times, the results obtained at 304 or 306 may be weighted, averaged or analyzed in any other beneficial manner and used to determine the amount of laundry and set one or more operating parameters. For example, the method 300 may be completed a plurality of times such that the controller 114 determines an average angular decay at 304 and uses the averaged angular decay value to determine the amount of laundry at 306. Alternatively, the method 300 may be completed such that the amount of laundry may be determined at 306 multiple times and the average amount of laundry may be used by the controller 114 to set one or more operating parameters.

Non-limiting examples of operating parameters that may be set by the controller include an amount of treatment to dispense, an amount of wash liquid to add, a speed and direction of rotation and a number of wash, rinse and spin phases.

The motor 126 may be controlled to simulate a spring by applying a particular torque at each angular displacement position of the drum 118. For example, the motor control algorithm may control the motor 126 to simulate a torsional spring. A torsion spring is a spring that stores mechanical energy when twisted. The torque exerted by the spring is proportional to the torsional stiffness multiplied by the angle of displacement from the predetermined position. The controller 114 can control the motor 126 to rotate the drum 118 by applying a predetermined torque depending on the angular position of the drum 118 and a predetermined torsional stiffness. In this manner, the drum 118 may be controlled to oscillate about the axis of the torsion spring (the drive shaft 130) to simulate a torsional harmonic oscillator. The magnitude of the torsional stiffness and the amount of torque to apply at each angular position may be determined experimentally and saved within the memory 170 of the controller 114.

Figure 6:
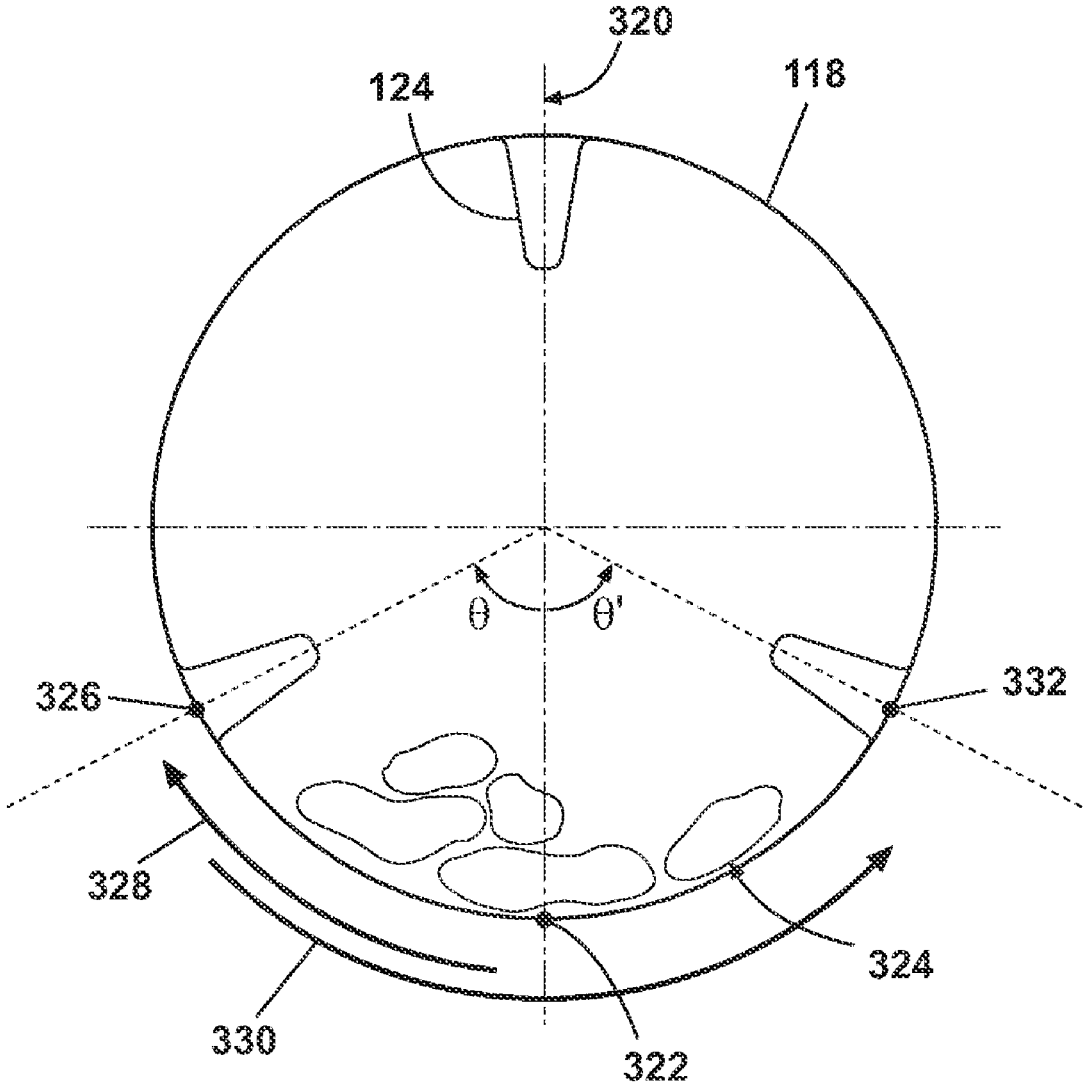
FIG. 6 is a schematic representation of the method for determining the first load amount illustrated in FIG. 5 according to the fourth embodiment of the invention.

FIG. 6 is a schematic representation of the drum 118 having super-imposed x-y coordinate axes 320 for illustrating the oscillation of the drum 118 about a predetermined position, such as an equilibrium position 322 according to 302 of the method 300 illustrated in FIG. 5. Alternatively, the predetermined position may be some position offset from the equilibrium position. Prior to the oscillation of the drum 118, load items 324 may generally be located at a bottom of the drum 118 distributed about the equilibrium position 322. At 302 in the method 300, the controller 114 may control the motor 126 to rotate the drum 118 according to the motor control algorithm stored in the memory 170 of the controller 114. The motor control algorithm may include rotating the drum 118 to a first angular displacement position 326 displaced from the equilibrium position 322 by a first angle θ, as illustrated by arrow 328. As illustrated by arrow 330, the motor 126 may then rotate the drum 118 in the opposite direction of the first rotation to a second angular displacement position 332 that is displaced from the equilibrium position 322 by a second angle θ'. The motor 126 may continue to rotate the drum 118 back and forth about the equilibrium position 322 according to the motor control algorithm.

The first angular displacement position 326 may be selected such that the drum 118 is rotated to a position just prior to the point at which the load may start to slip or slide within the treating chamber 116 along an interior surface of the drum 118. This slipping point may vary depending on the amount of the load, but may generally be considered to be between approximately 15 to 30 degrees. It is also within the scope of the invention for the drum 118 to be rotated to any position relative to the equilibrium position 322 less than 180 degrees. The acceleration of the drum 118 as it is rotated about the equilibrium position 322 is preferably selected such that the load 324 does not slide within the treating chamber 116. An example of a suitable drum acceleration is to move the load for 10 mechanical degree per second which translates to an acceleration of 0.03 radians per squared second (rad/s$^2$).

Figure 7:
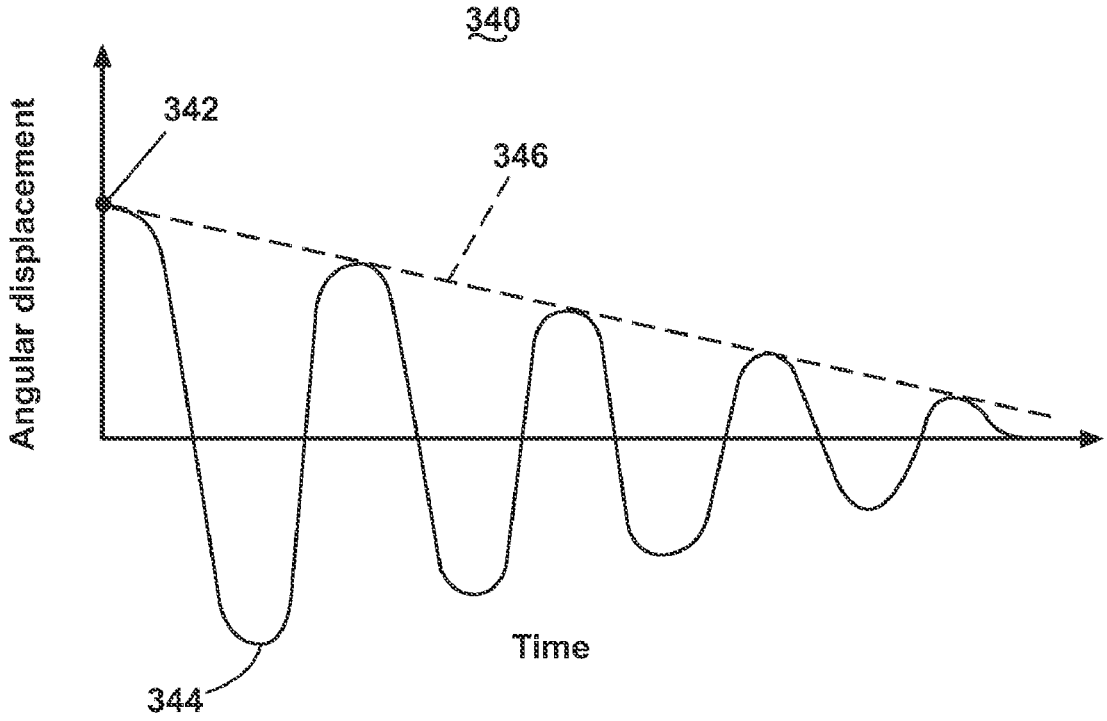
FIG. 7 is a schematic representation of a determination of an angular decay according to the method illustrated in FIG. 5 according to the fourth embodiment of the invention.

FIG. 7 is a schematic representation 340 of the angular displacement of the drum 118 as it is oscillated relative to the equilibrium position 322 to simulate a spring. FIG. 7 does not represent actual data, but is merely a schematic representation for the purposes of describing the invention. The starting point 342 corresponds to a first angular displacement position to which the drum 118 is initially rotated. The curve 344 illustrates the change in the angular displacement of the drum 118 over time as the motor 126 is controlled to simulate a spring and oscillate the drum 118 about the equilibrium position. This change in angular displacement of the drum 118 over time is proportional to the frequency of oscillation of the system, which is related to the amount of the load. Due to friction in the system, a damping force may be present that may cause the drum 118 containing a load of a given amount to oscillate at some frequency less than the actual resonance frequency of the system. The damping force may also cause the angular displacement of the drum 118 to decay over time, as illustrated by curve 346 in FIG. 6. This angular decay is also proportional to the amount of the load and may be used by the controller 114 to determine the amount of the load.

At 304 in the method 300 illustrated in FIG. 5, the controller 114 may be operably coupled with the motor 126 such that it can receive information from the motor 126 regarding the angular position of the drum 118 over time. The controller 114 may use the information regarding the angular position of the drum 118 to determine the angular decay of the drum 118 as it is being oscillated about the equilibrium position 322, using software stored in the memory 170 of the controller 114, for example.

The controller 114 may determine the angular decay of the drum 118 over some predetermined period of time. The determined angular decay may then be compared to an angular decay reference value for determining the amount of the load. Alternatively, the controller 114 may determine the angular decay based on the time it takes for the angular decay to reach a reference angular decay relative to the equilibrium position. The time it takes to reach the reference angular decay may then be compared to a reference value for determining the amount of the load. A plurality of reference angular decay or time values may be determined experimentally and stored in the memory 170 of the controller 114.

At 306 the controller 114 may use the determined angular decay to determine the amount of the load. This may correspond with the determination of the first load amount at 202 of the method 200 illustrated in FIG. 4 or it may be determined separately from the method 200. The determination at 306 may include comparing the determined angular decay to a reference value stored in the memory 170 of the controller 114. For example, a plurality of reference value may be determined experimentally for a variety of different load amounts and stored in the memory 170 of the controller 114. The reference values may be stored in a look-up table of corresponding load amounts that the controller 114 may consult at 306. The controller 114 may consult the look-up table and determine the amount of the load based on which reference value the determined angular decay is closest to. In one example, the load amount may be based on the weight of the load, and the look-up table may contain a plurality of reference values corresponding to a specific weight of laundry in kilograms, for example. In another example, the look-up table may contain a plurality of reference values that correspond to relative load amounts such as small, medium and large.

Alternatively, a plurality of reference values may be determined experimentally and used to generate a function for determining the amount of the load based on the determined angular decay. The function may be solved using the determined angular decay and the solution may be used to generate an output value that corresponds to a load amount.

The determined load amount at 306 may then be used at 202 in the method 200 illustrated in FIG. 4. For example, the method 300 may be repeated multiple times and an average of the load amount values determined at 306 may be used by the controller at 202 to determine the amount of the load. Alternatively, the determination of the load amount at 306 of the method 300 illustrated in FIG. 5 may correspond to the determination of the first load amount at 202 in the method 200.

Figure 8:
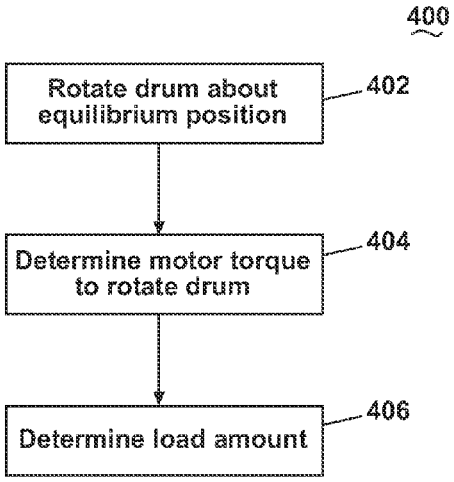
FIG. 8 is a flow chart illustrating a method for determining a first load amount of a load within a laundry treating appliance according to a fifth embodiment of the invention.

FIG. 8 illustrates another example of a suitable first load amount method 400 that may be used at 202 in the method 200 of FIG. 4 to determine the first load amount. The method 400 is similar to the method 300 in that the drum 118 is rotated about a predetermined position. In the method 400, rather than controlling the motor 126 to simulate a spring and using the angular decay of the drum 118 to estimate the load amount, the energy required to rotate the drum 118 between a first and a second predetermined angular position is used to estimate the load amount. The amount of energy required to rotate the drum 118 between a first and a second predetermined angular position may be determined by the motor torque required to rotate the drum 118. While the method 400 is described in the context of motor torque, it is within the scope of the invention for any motor control signal indicative of the energy required to rotate the drum 118, such as the motor power (active, reactive, or apparent power), motor input phase angle, current or voltage or any associate components such as flux or torque components, to be used.

According to the method 400, at 402 the controller 114 may drive the motor 126 to rotate the drum 118 about a predetermined position by less than plus/minus 180 degrees to a predetermined first and second angular position. At 404 the torque required to rotate the drum 118 to the first and second predetermined angular positions is determined. The determined torques or a function of the determined torques for the first and second angular positions may then be used to estimate the amount of the load at 406. For example, the amount of the load at 406 may be determined based on the combined value or difference in the torque required to move the drum to the first and second angular positions.

Figure 9:
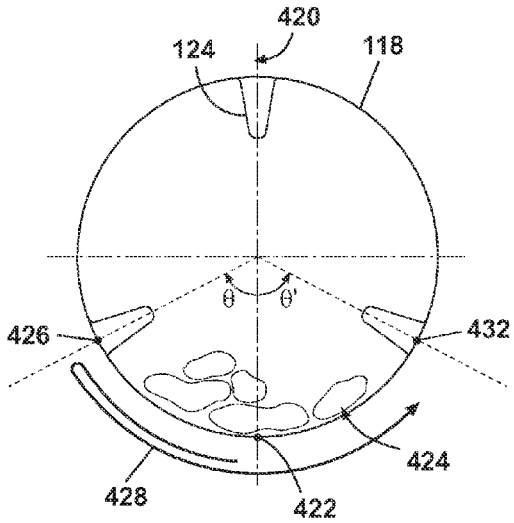
FIG. 9 is a schematic representation of the method for determining the first load amount illustrated in FIG. 8 according to the fifth embodiment of the invention.

FIG. 9 is a schematic representation of the drum 118 having super-imposed x-y coordinate axes 420 for illustrating the oscillation of the drum 118 about a predetermined position, such as an equilibrium position 422 according to 402 of the method 400 illustrated in FIG. 8. Prior to the oscillation of the drum 118, load items 424 may generally be located at a bottom of the drum 118 distributed about the equilibrium position 422. At 402 in the method 400, the controller 114 may control the motor 126 to rotate the drum 118 to a first angular position 426 and a second angular position 432 as illustrated by arrow 428. As illustrated by arrow 428, the motor 126 may rotate the drum to the first angular position 426, displaced from the equilibrium position 422 by a first angle $\theta$, and to a second angular position 432 displaced from the equilibrium position 422 by a second angle $\theta'$.

The first angular and second angular positions 426, 432 may be selected such that the drum 118 is rotated to a position just prior to the point at which the load may start to slip or slide within the treating chamber 116 along an interior surface of the drum 118. This slipping point may vary depending on the amount of the load, but may generally be considered to be between approximately 15 to 30 degrees. It is also within the scope of the invention for the drum 118 to be rotated to any position relative to the equilibrium position 422 less than 180 degrees. During the rotation of the drum 118, the acceleration may also be selected such that the load 424 does not slip or slide within the treating chamber 116.

The acceleration from the equilibrium position 422 to the first angular position 426 and/or the acceleration from the first angular position 426 to the second angular position 432 may be linear or non-linear. For example, the acceleration can be non-linear such that the load is gradually moved to an initial position and then gradually stopped at a desired position. A non-linear acceleration curve for rotating the drum from an initial position to a desired position may be used to minimize disturbance of the load during rotation and reduce the likelihood that the load will slip or slide. A non-limiting example of a suitable acceleration curve may be in the form of a simple "S" curve in which the starting and stopping acceleration has a derivative of zero, providing a soft start and a soft stop.

In another example, the acceleration may be dynamically adjusted based on one or more motor control signals, such as motor torque. For example, changes in the motor torque during rotation of the drum may be used to identify a load movement condition, such as sliding of the load. If it is determined that the motor torque indicates that the load is sliding, the acceleration of the drum can be decreased or set to a predetermined value until the load movement condition is removed. In this manner, a soft start and stop may be obtained.

The drum rotation and torque determination at 402 and 404 of the method 400 may be repeated multiple times and the torque required to rotate the drum 118 may be averaged and used to determine the load amount at 406. Alternatively, the drum 118 may be rotated multiple times to a plurality of different sets of first and second angular positions and the average torque required for each of the different sets of first and second angular positions may be determined at 404 and used to determine the amount of the load at 406. The number of rotations and the angular positions may be predetermined and stored in the controller memory 170. Alternatively, the number and degree of rotations may be determined dynamically during the method 400 depending on the recorded torque data. For example, the drum 118 may be rotated to increasing degrees of displacement from the equilibrium position until a maximum or minimum torque value is recorded.

The determined torque value for each set of angular positions determined at 404 may be analyzed and correlated to a load amount at 406. For example, the stored torque values may be analyzed by determining a mean torque value and this torque value may be compared to the torque values in a look-up table of corresponding torque values and load amounts stored in the controller memory 170 to determine the load amount. Alternatively, the determined torque values may be analyzed according to one or more functions and the function output may be used to determine the amount of the load. In one example, the determined torque values at each angular position may be analyzed using regression analysis and the results of the analysis may be used by the controller 114 to determine the amount of the load. The torque and corresponding angular position data may be determined experimentally and used to provide one or more look-up tables or functions for determining the amount of the load according to the method 400. The determined load amount at 406 may then be used at 202 in the method 200 illustrated in FIG. 4. For example, the method 400 may be repeated multiple times and an average of the load amount values determined at 406 may be used by the controller at 202 to determine the amount of the load. Alternatively, the determination of the load amount at 406 of the method 400 illustrated in FIG. 9 may correspond to the determination of the first load amount at 202 in the method 200.

Figure 10:
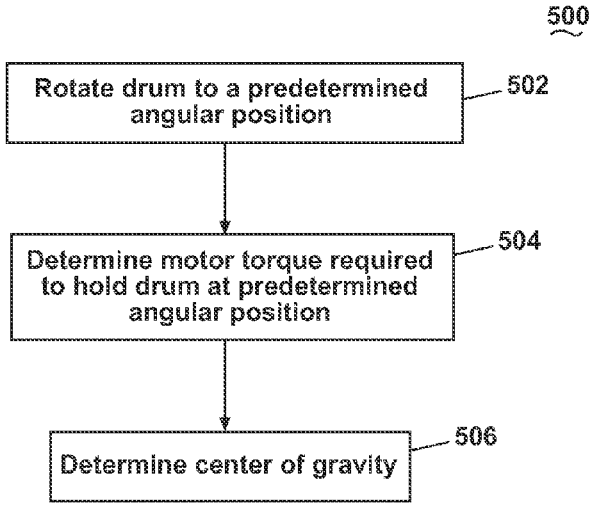
FIG. 10 is a flow chart illustrating a method for determining a center of gravity of a load within a laundry treating appliance according to a sixth embodiment of the invention.

FIG. 10 illustrates an example of a suitable method 500 that may be used at 212 in the method 200 of FIG. 4 to determine the center of gravity of the load. In the method 500, the energy required to hold the drum 118 at a predetermined angular position is used to estimate the center of gravity of the load. The amount of energy required to hold the drum 118 at a predetermined angular position may be determined by the motor torque required to hold the drum 118 at that position. While the method 500 is described in the context of motor torque, it is within the scope of the invention for any motor control signal indicative of the energy required to rotate the drum 118, such as the motor power, current or voltage, to be used.

According to the method 500, at 502 the controller 114 may drive the motor 126 to rotate the drum 118 from a predetermined position to a predetermined angular position. At 404 the torque required to hold the drum 118 at the predetermined angular position is determined. The determined torque may then be used to estimate the center of gravity at 506.

The drum rotation and torque determination at 502 and 504 may be repeated multiple times for one or more angular positions and the torque required to hold the drum 118 at the one or more angular positions may be used to determine the center of gravity of the load at 506. The drum 118 may be rotated to each angular position multiple times and the average torque value determined at 504. Alternatively, a single drum rotation may be used to determine the torque at 504. The number of rotations and the angular positions completed at 502 may be predetermined and stored in the controller memory 170. Alternatively, the number and degree of rotations may be determined dynamically during the method 500 depending on the determined torque data. For example, the drum 118 may be rotated to increasing degrees of displacement from the equilibrium angle until a maximum or minimum torque value is recorded.

In one example, the drum 118 may be rotated at 502 to angular positions increasingly spaced from a predetermined position and the torque required to hold the drum 118 at each position may be analyzed to determine at what point the load starts to slip or slide along the interior surface of the drum 118. The angular position at which the slipping point occurs may then be used to determine the center of gravity of the load at 506.

Figure 11A:
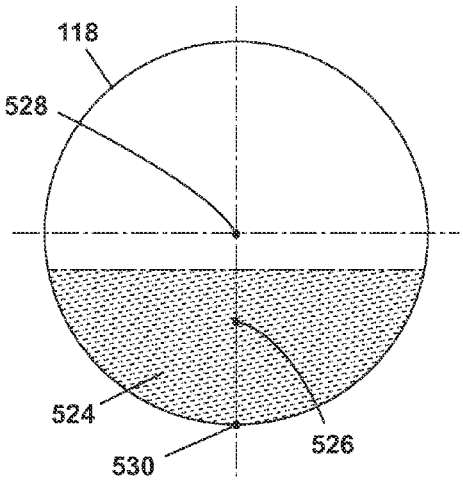
FIGS. 11A-D are schematic representations of a method for determining a center of gravity of a load according to a seventh embodiment of the invention.
Figure 11B:
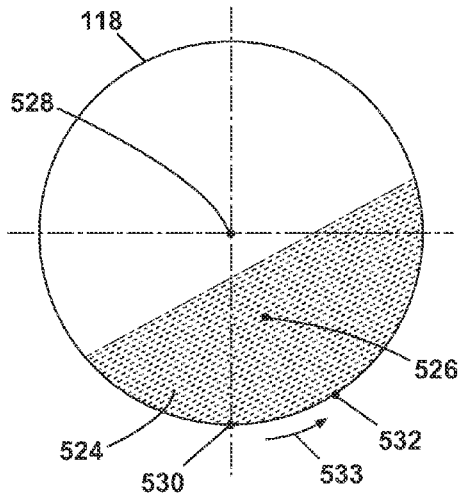

FIGS. 11A-D are a schematic representation illustrating the change in the center of gravity of a load as the drum 118 is rotated to an angular position displaced from a predetermined position, such as an equilibrium position 530. Referring now to FIG. 11A, prior to rotation of the drum 118, the load 524 may generally be considered to be located at the bottom of the drum 118. The load 524 may have a center of gravity 526 spaced below the axis of rotation 528 of the drum 118. The center of gravity 526 may depend on the number, amount and fabric type of the articles forming the load 524. As illustrated in FIG. 11B, as the drum 118 is rotated from the equilibrium position 530 to a first position 532, as illustrated by arrow 533, the center of gravity 526 is offset from and no longer aligned below the axis of rotation 528. At some point, as the drum 118 is rotated and held at angular positions increasingly spaced from the equilibrium position 530, the load 524 may slip or slide down the interior surface of the drum 118 as the effect of gravity overcomes the effect of friction between the load 524 and the interior surface of the drum 118. At this point the torque required to hold the drum 118 at angular positions increasingly spaced from the equilibrium position 530 stops increasing and a maximum in the required torque may be observed at the angular position just prior to the angular position at which the load 524 slips.

Figure 11C:
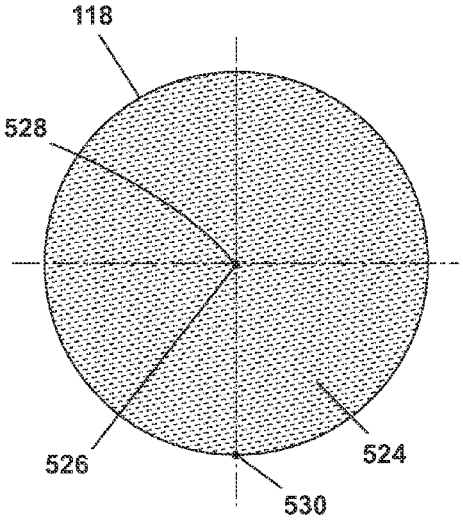
Figure 11D:
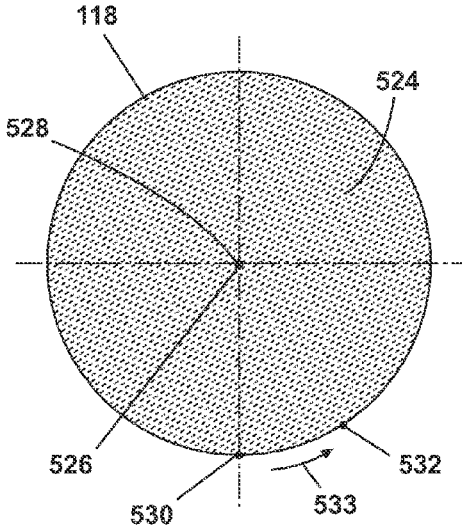

FIGS. 11C and 11D illustrate how the amount of the load effects the change in the center of gravity as the drum 118 is rotated. As illustrated in FIG. 11C, the amount of the load 524 is such that it substantially fills the treating chamber 116 defined by the drum 118. Prior to rotation of the drum 118, the center of gravity 526 of the load is generally aligned with the axis of rotation 528 of the drum 118. As illustrated in FIG. 11D, as the drum 118 is rotated from the equilibrium position 530 to the first position 532, as illustrated by arrow 533, the location of the center of gravity 526 changes insignificantly or not at all. Because the load 524 generally fills the treating chamber 116, the drum 118 may be rotated to 180 degrees without the load 524 slipping, which may be indicated by a lack of a decrease in the torque required to hold the drum 118 at a particular angular position.

The torque values determined at each angular position may be analyzed by the controller 114 at 506 to determine the center of gravity of the load by determining the position at which the load 524 starts to slip. The position at which the load starts to slip may be determined by the controller 114 by determining the position at which the torque required to hold the drum 118 at that position is at a maximum. The controller 114 may then consult a look-up table of slipping positions and corresponding output values for the center of gravity. The output value for the center of gravity may be a value indicative of the relative location of the center of gravity within the drum 118 or the output value may simply be a "yes" or "no" output indicating that the center of gravity either is or is not offset from the axis of rotation of the drum 118. If no slipping position may be determined from the torque data, the controller 114 may determine that the drum 118 is full, such as is illustrated schematically in FIGS. 11C-D, and that the center of gravity is not offset from the axis of rotation of the drum 118.

In another example, the center of gravity of the load may be determined at 506 based on the correlation of the torque required to hold the drum 118 at different angular positions and the amount of the load. The torque $\tau$ required to hold the drum 118 at different angular positions can be correlated to the mass and center of gravity of the load according to the equation $\tau=-mgL\sin\theta$, where m is the mass of the load, g is the gravitational constant, L is the length of the distance from the pivot point (the axis of rotation of the drum) to the center of gravity of the load and $\theta$ is the displacement angle from vertical (the equilibrium position).

Figure 12:
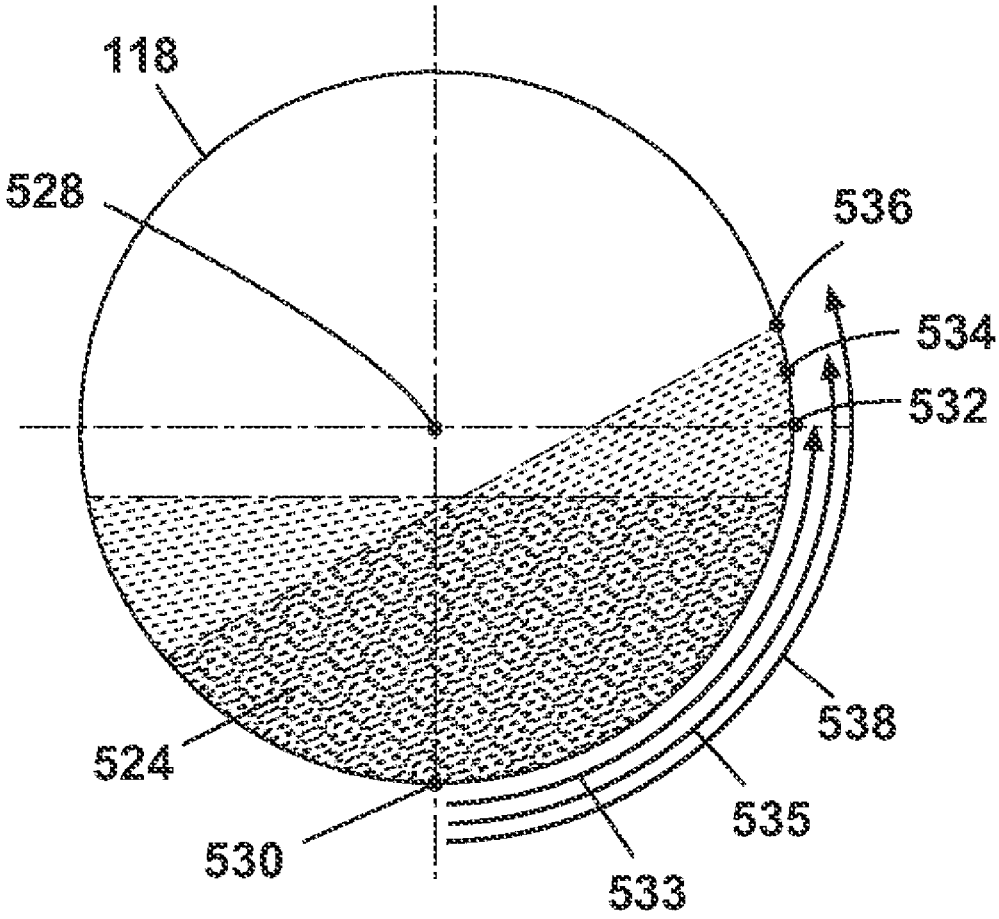
FIG. 12 is a schematic representation of a method for determining a center of gravity of a load according to an eighth embodiment of the invention.

As illustrated schematically in FIG. 12, the drum 118 may be rotated from the equilibrium position 530 to a first position 532, as illustrated by arrow 533, and the torque required to hold the drum 118 at the first position 532 may be recorded. The drum 118 may then be rotated to a second position 534 as illustrated by arrow 535 and a third position 536 as illustrated by arrow 538, and the torque required to hold the drum at each of the second and third positions 534, 536 may be recorded. The drum 118 may be rotated to any number of angular positions having any regular or irregular degree of spacing for determining the center of gravity of the load.

The torque values determined at each angular position may be analyzed by the controller 114 at 506 to determine the center of gravity of the load depending on the amount of the load determined previously. The amount of the load may be determined using any of the methods disclosed herein or using some other suitable method. The center of gravity of a load of a particular amount may be determined by comparing the determined torque values to experimentally determined torque values for the corresponding load amount. The experimentally determined torque values may be stored in a look-up table of torque values and output values corresponding to the center of gravity of the load in the controller memory 170. Alternatively, the determined torque values at each angular position may be analyzed using regression analysis and the results of the analysis may be used by the controller 114 to determine the center of gravity of the load.

The determination of the center of gravity of the load at 506 according to the method 500 may be a determination of whether or not the center of gravity of the load corresponds to the axis of rotation of the drum 118. Alternatively, the determination of the center of gravity of the load may be a determination of the relative location of the center of gravity within the drum 118. For example, the determination of the center of gravity of load at 506 may include determining the distance L from the axis of rotation of the drum 118 to the center of gravity of the load. The determined distance L may then be used by the controller 114 to determine the relative location of the center of gravity of the load within the drum 118 or to determine if the center of gravity of the load is offset from the axis of rotation of the drum 118 by some distance greater than a predetermined threshold distance. In another example, the determined distance L may be used to determine the relative position of the center of gravity within the drum 118 by relative to an x, y-z coordinate system within the drum 118 having its origin at the axis of rotation of the drum 118. In another example, the treating chamber 116 may be divided into regions and the center of gravity may be defined based on which region within the drum 118 it is located.

The determination of the center of gravity at 506 in the method 500 may be used by the controller 114 at 212 in the method 200 illustrated in FIG. 4 to determine if the center of gravity is offset from the axis of rotation of the drum 118. In one example, the determination of the center of gravity at 506 in the method 500 may correspond to the determination of whether the center of gravity is offset from the axis of rotation at 212. In another example, the controller 114 may determine at 506 of the method 500 that the center of gravity of the drum is located in a predefined region within the drum 118. The controller 114 may then determine if the center of gravity is offset from the axis of rotation at 212 in the method 200 based on the region in which the center of gravity is located as determined at 506 of the method 500.

For example, the treating chamber 116 may be divided into two concentric regions, an inner region and an outer region, each having a central axis corresponding to the axis of rotation of the drum 118. The inner region may include the area within the treating chamber 116 corresponding to the axis of rotation of the drum 118. The outer region may surround the inner region and generally extend from the inner region to sidewalls of the drum 118. The outer region may correspond to the region in which the center of gravity may be determined to be offset from the axis of rotation of the drum. If the controller 114 determines that the center of gravity is in the outer region 506 of the method 500, this determination may then be used by the controller 114 at 212 in the method 200 to determine that the center of gravity is offset from the axis of rotation of the drum 118.

The method and apparatus for determining the amount of the load according to the invention is advantageous in that they may be used to determine which of two load amount methods is less likely to contribute to the natural wearing process of the fabric load. For large load amounts, a load amount determining method based on a traditional inertia-based method, which often requires high speeds and/or accelerations, may be more likely to contribute to the natural wearing process of the fabric load than the first load amount method. Large load amounts may include those loads having a high weight and also those loads having a large volume that substantially fills the treating chamber. The methods for determining the first load amount as described above have the advantage of using low speeds, speeds below the satelliting speed, small accelerations, which may result in less mechanical energy being transferred to the load than occurs when using an inertia-based method. The determination of the center of gravity of the load also assists in determining which method is less likely to contribute to the natural wearing process of the fabric load. The determination of the center of gravity of the load provides a method for determining when one or more large or bulky items are located in the drum. While these large or bulky items may be low in weight, the load may still be more amenable to the first load amount method, which may be less likely to contribute to the natural wearing process of the fabric load, than the second, inertia-based load method. The method and apparatus described herein provides a way to determine whether an inertia-based load amount determining method is likely to contribute to the natural wearing process of the fabric load and an alternative method if it is determined that the inertia-based method is likely to contribute to the natural wearing process of the fabric load.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method for determining the amount of laundry in a laundry treating appliance comprising a drum defining a treating chamber for receiving the laundry and a motor for rotating the drum about an axis of rotation, the method comprising:

oscillating the drum about a predetermined position by driving the motor in a manner to simulate a torsional spring;

determining an angular decay of the drum relative to the predetermined position based on a characteristic of the oscillating of the drum;

determining whether the angular decay of the drum relative to the predetermined position satisfies a load threshold characteristic;

rotating the drum in accordance with a laundry inertia algorithm to determine the inertia of the load when the angular decay of the drum relative to the predetermined position satisfies the load threshold characteristic; and determining a load amount characteristic based on the inertia of the laundry.

2. The method of claim 1 wherein determining the angular decay comprises determining the angular decay over a predetermined period of time.

3. The method of claim 1 wherein determining the angular decay comprises determining the time it takes for the angular decay to reach a reference angular decay relative to the predetermined position.

4. The method of claim 1 wherein oscillating the drum comprises rotating the drum less than 180 degrees from the predetermined position.

5. The method of claim 1 wherein the load threshold characteristic is a load characteristic upper limit.

6. The method of claim 5 wherein the load threshold characteristic is satisfied when the angular decay of the drum relative to the predetermined position is less than the load characteristic upper limit.

7. The method of claim 6, further comprising determining at least one of an absolute and relative amount of offset of the center of gravity of the laundry from the axis of rotation.

8. The method of claim 6 wherein the load threshold characteristic is satisfied when the angular decay of the drum relative to the predetermined position is less than the load characteristic upper limit and the center of gravity is offset from the axis of rotation by a predetermined amount.

9. The method of claim 1, further comprising determining a value indicative of the relative or absolute location of the center of gravity of the load.

10. The method of claim 9 wherein the load amount characteristic is determined when the angular decay of the drum relative to the predetermined position satisfies the load threshold characteristic and the value indicative of the center of gravity of the load satisfies a threshold value.

11. A method for determining the amount of laundry in a laundry treating appliance comprising a drum defining a treating chamber for receiving the laundry and a motor for rotating the drum about an axis of rotation, the method comprising:

rotating the drum at a speed below a speed threshold according to a first load amount algorithm;

determining a load amount characteristic based on a characteristic of the rotating of the drum below the speed threshold;

determining whether the load amount characteristic satisfies a load threshold characteristic;

rotating the drum above the speed threshold according to a second load amount algorithm, when the load amount characteristic satisfies the load threshold characteristic; and determining the inertia of the laundry based on a characteristic of rotating the drum above the speed threshold.

12. The method of claim 11 wherein rotating the drum comprises oscillating the drum about a predetermined position.

13. The method of claim 11 wherein rotating the drum comprises operating the motor to rotate the drum in a manner to simulate a torsional spring.

14. The method of claim 11 wherein the load threshold characteristic is a load characteristic upper limit.

15. The method of claim 14 wherein the load amount characteristic satisfies the load characteristic upper limit when the load amount characteristic is less than the load characteristic upper limit.

16. The method of claim 15, further comprising determining at least one of an absolute and relative amount of offset of the center of gravity of the laundry from the axis of rotation.

17. The method of claim 16 wherein the load threshold characteristic is satisfied when the load amount characteristic is less than the load characteristic upper limit and the center of gravity is offset from the axis of rotation by a predetermined amount.

18. The method of claim 11, further comprising determining a value indicative of the relative or absolute location of the center of gravity of the load.

19. The method of claim 18 wherein the inertia of the laundry is determined when the load amount characteristic satisfies the load threshold characteristic and the value indicative of the center of gravity of the load satisfies a threshold value.

20. A laundry treating appliance comprising:

a drum defining a treating chamber for receiving laundry and rotatable about an axis of rotation;

a motor operably coupled to the drum to rotate the drum about the axis of rotation; and a controller operably coupled to the motor to rotate the drum according to a first load amount algorithm to determine a load amount characteristic and according to a second load amount algorithm different than the first load amount algorithm to determine the inertia of the laundry, the second load amount algorithm configured to rotate the drum at a faster speed than the first load amount algorithm;

wherein the controller is configured to determine whether the load amount characteristic satisfies a load threshold characteristic, and is further configured to determine the inertia of the laundry only when the load amount characteristic satisfies the load threshold characteristic.

21. The laundry treating appliance of claim 20 wherein the first load amount algorithm comprises oscillating the drum about a predetermined position.

22. The laundry treating appliance of claim 20 wherein the first load amount algorithm comprises operating the motor to rotate the drum in a manner to simulate a torsional spring.

23. The laundry treating appliance of claim 20 wherein the controller is configured to determine that the load threshold characteristic is satisfied when at least one of the following occurs:

the load amount characteristic is less than a load characteristic upper limit;

the load amount characteristic is greater than a load characteristic lower limit;

at least one of an absolute and relative center of gravity of the load is offset from the laundry axis of rotation; and a value indicative of the center of gravity of the load satisfies a threshold value.

24. The laundry treating appliance of claim 20 wherein the controller is further configured to determine a value indicative of the relative or absolute location of the center of gravity of the load.

* * * * *